US005246546A

United States Patent [19]

Ampulski

[11] Patent Number: 5,246,546

[45] Date of Patent: Sep. 21, 1993

[54] PROCESS FOR APPLYING A THIN FILM CONTAINING POLYSILOXANE TO TISSUE PAPER

[75] Inventor: Robert S. Ampulski, Fairfield, Ohio

[73] Assignee: Procter & Gamble Company, Cincinnati, Ohio

[21] Appl. No.: 936,439

[22] Filed: Aug. 27, 1992

[51] Int. Cl.[5] ..... D21H 21/22

[52] U.S. Cl. ..... 162/112; 162/113; 162/135; 162/136; 162/158; 162/164.4; 162/206

[58] Field of Search ..... 162/111, 112, 113, 135, 162/136, 184, 164.4, 1, 58, 206, 207; 156/183; 264/282, 283

[56] References Cited

U.S. PATENT DOCUMENTS

| | | | |
|---|---|---|---|
| 2,309,089 | 1/1943 | Bauer et al. | 162/184 |
| 2,826,551 | 3/1958 | Geen | 252/89 |
| 3,301,746 | 1/1967 | Sanford et al. | 162/113 |
| 3,438,807 | 4/1969 | Pikula | 117/154 |
| 3,484,275 | 12/1969 | Lewicki, Jr. | 117/93.4 |
| 3,755,071 | 8/1973 | Bey et al. | 162/184 |
| 3,755,220 | 8/1973 | Freimark et al. | 260/17.3 |
| 3,812,000 | 5/1974 | Salvucci, Jr. et al. | 162/111 |
| 3,814,096 | 6/1974 | Weiss et al. | 128/260 |
| 3,818,533 | 6/1974 | Scheuer | 15/104.93 |
| 3,821,068 | 6/1974 | Shaw | 162/111 |
| 3,844,880 | 10/1974 | Meisel, Jr. et al. | 162/169 |
| 3,964,500 | 6/1976 | Drakoff | 132/7 |
| 3,967,030 | 6/1976 | Johnson et al. | 428/266 |
| 3,974,025 | 8/1976 | Ayers | 162/113 |
| 3,994,771 | 11/1976 | Morgan, Jr. et al. | 162/113 |
| 4,028,172 | 6/1977 | Mazzarella | 162/164 R |
| 4,112,167 | 9/1978 | Dake et al. | 428/154 |
| 4,191,609 | 3/1980 | Trokhan | 162/113 |
| 4,300,981 | 11/1981 | Carstens | 162/109 |
| 4,355,021 | 10/1982 | Mahl et al. | 424/28 |
| 4,376,149 | 3/1983 | Martin | 428/266 |
| 4,395,454 | 7/1983 | Baldwin | 428/290 |
| 4,447,294 | 5/1984 | Osborn | 162/158 |
| 4,469,840 | 9/1984 | Alberts et al. | 524/500 |
| 4,481,243 | 11/1984 | Allen | 428/154 |
| 4,513,051 | 4/1985 | Lavash | 428/212 |
| 4,637,859 | 1/1987 | Trokhan | 162/109 |
| 4,795,530 | 1/1989 | Soerens et al. | 162/11 |
| 4,940,513 | 7/1990 | Spendel | 162/112 |
| 4,950,545 | 8/1990 | Walter et al. | 428/446 |
| 4,959,125 | 9/1990 | Spendel | 162/158 |
| 5,059,282 | 10/1991 | Ampulski et al. | 162/111 |
| 5,164,046 | 11/1992 | Ampulski et al. | 162/111 |

FOREIGN PATENT DOCUMENTS

| | | | |
|---|---|---|---|
| 899223 | 5/1972 | Canada . | |
| 0144658 | 6/1985 | European Pat. Off. . | |
| 347153 | 12/1989 | European Pat. Off. | 162/112 |
| 3420940 | 1/1985 | Fed. Rep. of Germany . | |

*Primary Examiner*—Peter Chin

*Attorney, Agent, or Firm*—Bart S. Hersko; Fredrick H. Braun

[57] ABSTRACT

Disclosed is a process for making soft tissue paper which includes providing a dry tissue web and then applying a sufficient amount of a polysiloxane softener compound to the dry web. The softener application process includes the steps of diluting a polysiloxane compound with a suitable solvent, applying the diluted polysiloxane solution to a heated transfer surface, evaporating the solvent from the dilute solution to form a film, and then contacting the dry tissue web with the heated transfer surface. Preferably, the tissue web is dried to a moisture level below its equilibrium moisture content before application of the polysiloxane material. The process may further include the steps of applying an effective amount of a surfactant material to enhance softness and/or wettability control; and/or an effective amount of a binder material such as starch, for linting control, and/or to contribute tensile strength to the tissue paper.

20 Claims, 1 Drawing Sheet

PROCESS FOR APPLYING A THIN FILM CONTAINING POLYSILOXANE TO TISSUE PAPER

TECHNICAL FIELD

This invention relates, in general, to a process for preparing tissue paper; and more specifically, to a process for preparing high bulk tissue paper having a soft, silkyl, flannel-like tactile feel; and enhanced tactile perceivable bulk, and physiological surface smoothness.

BACKGROUND OF THE INVENTION

Soft tissue paper is generally preferred for disposable paper towels, and facial and toilet tissues. However, known methods and means for enhancing softness of tissue paper generally adversely affect tensile strength. Tissue paper product design is, therefore, generally, an exercise in balancing softness against tensile strength. Both mechanical and chemical means have been introduced in the pursuit of making soft tissue paper: tissue paper which is perceived by users, through their tactile sense, to be soft. Such tactile perceivable softness may be characterized by, but not limited to, friction, flexibility, and smoothness; and subjective descriptors such as feeling like silk or flannel. The present invention pertains to a process for improving the tactile perceivable softness of tissue paper—in particular high bulk, creped tissue paper—through the incorporation of chemical additives: in particular, polysiloxane materials which impart a silky or flannel-like feel to the tissue paper without rendering it greasy or oily to the tactile sense of users of products comprising such tissue paper. Additionally, surfactant material may be added to further enhance softness and/or surface smoothness and/or to at least partially offset any reduction in wettability caused by the polysiloxane; and binder material such as starch may be added to at least partially offset reductions in strength and or increasing in linting proclivity that results from the polysiloxane and, if used, the surfactant additive.

Representative high bulk, creped tissue papers which are quite soft by contemporary standards, and which are susceptible to softness enhancement through the present invention are disclosed in the following U.S. Pat. Nos.: 3,301,746 which issued Jan. 31, 1967, to Lawrence H. Sanford and James B. Sisson; 3,974,025 which issued Aug. 10, 1976, to Peter G. Ayers; 3,994,771 which issued Nov. 30, 1976, to George Morgan, Jr. and Thomas F. Rich; 4,191,609 which issued Mar. 4, 1980, to Paul D. Trokhan; and 4,637,859 which issued Jan. 20, 1987, to Paul D. Trokhan. Each of these papers is characterized by a pattern of dense areas: areas more dense than their respective remainders, such dense areas resulting from being compacted during papermaking as by the crossover knuckles of imprinting carrier fabrics. Other high bulk, soft tissue papers are disclosed in U.S. Pat. No. 4,300,981 which issued Nov. 17, 1981, to Jerry E. Carstens; and 4,440,597 which issued Apr. 3, 1984, to Edward R. Wells and Thomas A. Hensler. Additionally, achieving high bulk tissue paper through the avoidance of overall compaction prior to final drying is disclosed in U.S. Pat. No. 3,821,068 which issued Jun. 28, 1974, to D. L. Shaw; and avoidance of overall compaction in combination with the use of debonders and elastomeric bonders in the papermaking furnish is disclosed in U.S. Pat. No. 3,812,000 which issued May 21, 1974, to J. L. Salvucci, Jr.

Chemical debonders such as those contemplated by Salvucci, referred to above, and their operative theory are disclosed in such representative U.S. Pat. Nos. 3,755,220 which issued Aug. 28, 1973, to Friemark et al.; 3,844,880 which issued Oct. 29, 1974, to Meisel et al.; and 4,158,594 which issued Jan. 19, 1979, to Becker et al.

Tissue paper has also been treated with cationic surfactants, as well as noncationic surfactants to enhance softness See, for example, U.S. Pat. No. 4,959,125 which issued Sep. 25, 1990, to Spendel; and U.S. Pat. No. 4,940,513 which issued Jul. 10, 1990, to Spendel, that disclose processes for enhancing the softness of tissue paper by treating it with noncationic, preferably nonionic, surfactants.

It has been found that the softness of tissue paper, in particular, high bulk pattern densified tissue papers, can be improved by treatment with various agents such as vegetable, animal or synthetic oils, and especially polysiloxane materials typically referred to as silicone oils. See, for example, U.S. Pat. No. 5,059,282 which issued Oct. 22, 1991, to Ampulski et al. The Ampulski patent discloses a process for adding a polysiloxane compound to a wet tissue web (preferably at a fiber consistency of between about 20% and about 35%). These polysiloxane compounds impart a silky, soft feeling to the tissue paper. However, addition of the polysiloxane to the tissue web before the web is dried and creped, in accordance with the process disclosed in U.S. Pat. No. '282, can result in interference with the coating on the Yankee dryer and also cause skip crepe and a loss in sheet control Importantly, these problems are eliminated by the process of the present invention wherein the polysiloxane is added to the tissue sheet after the sheet leaves the Yankee dryer.

Additionally, a well known mechanical method of increasing tensile strength of paper made from cellulosic pulp is by mechanically refining the pulp prior to papermaking. In general, greater refining results in greater tensile strength However, consistent with the foregoing discussion of tissue tensile strength and softness, increased mechanical refining of cellulosic pulp negatively impacts tissue paper softness, all other aspects of the papermaking furnish and process being unchanged. However, through the use of the present invention, tensile strength can be increased without negatively impacting softness; or, alternatively, softness can be improved without negatively impacting tensile strength It is an object of this invention to provide a process for preparing tissue paper which has an enhanced tactile sense of softness It is another object of this invention to provide a process for preparing tissue paper which has a silky, flannel-like feel.

It is another object of this invention to provide a process for preparing tissue paper which has increased tactile softness at a particular level of tensile strength relative to tissue paper which has been softened by conventional techniques.

It is a further object to provide a process for preparing a soft tissue paper by applying a polysiloxane compound to a dry tissue web from a thin film.

These and other objects are obtained using the present invention, as will be seen from the following disclosure.

SUMMARY OF THE INVENTION

The present invention encompasses a process for making soft tissue paper. This process includes the steps of providing a dry tissue paper web and then applying a sufficient amount of a polysiloxane softener compound to the dry web. More specifically, the softener application process includes the steps of diluting a polysiloxane compound with a suitable solvent to form a diluted polysiloxane solution; applying the diluted polysiloxane solution to a heated transfer surface by, for example, spraying; and evaporating a portion of the solvent from the heated transfer surface to form a film containing the active softener. Next, at least one outwardly-facing surface of the dry tissue paper web is contacted with the heated transfer surface resulting in a transfer of a sufficient amount of the polysiloxane compound such that between about 0.004%; and about 0.75% of said polysiloxane, dry fiber weight basis, is retained by the tissue paper. If the solvent is water then, preferably, the hot web is dried to a moisture level below its equilibrium moisture content (at standard conditions) before being contacted with the polysiloxane film, however this process is also applicable to tissue paper at its equilibrium moisture as well, if most of the water is evaporated from the transfer surface The amount of polysiloxane retained by the tissue paper is preferably, between 0.01% to about 0.3%, based on the dry fiber weight of the tissue paper. The resulting tissue paper preferably has a basis weight of from about 10 to about 65 g/m$^2$ and a fiber density of less than about 0.6 g/cc.

As mentioned above, the polysiloxane is applied to the web preferably, after the web has been dried and creped. By adding the polysiloxane to the web after drying and creping, there is no interference with the glue on the Yankee dryer, which can cause skip crepe and/or loss in sheet control. Preferably, the polysiloxane compound is applied to a hot, creped web after it leaves the doctor blade and before it is wound on the parent roll. Surprisingly, it has been found that significant tissue softening benefits can be achieved by low levels of polysiloxanes when the polysiloxane is diluted with a solvent, applied to a heated transfer surface which evaporates the carrier solvent and then transfers the polysiloxane compound to a hot web before the converting operation. An advantage of the process disclosed herein, is that the amount of residual solvent transferred to the paper web is sufficiently low that it does not degrade other product properties. In addition, the quantity of polysiloxane used is low enough to be economical. Also, tissue paper treated with low levels of polysiloxane retain a high level of wettability, an important feature for a tissue product.

Preferred polysiloxanes for use in the process of the present invention include an amino-functional polydimethylpolysiloxane wherein less than about 10 mole percent of the side chains on the polymer contain an amino-functional group. Because molecular weights of polysiloxanes can be difficult to ascertain, the viscosity of a polysiloxane is used herein as an objectively ascertainable indicia of molecular weight. Accordingly, for example, about 2% substitution has been found to be very effective for polysiloxanes having a viscosity of about one-hundred-twenty-five (125) centistokes; and viscosities of about five-million (5,000,000) centistokes or more are effective with or without substitution. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and amino-functional groups are most preferred.

Exemplary commercially available polysiloxanes include DOW 8075 and DOW 200 which are available from Dow Corning; and Silwet 720 and Ucarsil EPS which are available from Union Carbide.

The process for preparing tissue paper treated with a polysiloxane in accordance with the present invention may further comprise the step of adding an effective amount of a surfactant to enhance the tactile perceivable surface smoothness of the tissue paper and/or to at least partially offset any reduction of wettability of the tissue paper which would otherwise result from the incorporation of the polysiloxane. The effective amount of surfactant is such that, preferably, from about 0.01 to about 2 percent on a dry fiber weight of the tissue paper; and, more preferably, from about 0.05 to about 1.0 percent is retained by the tissue paper. Also, preferably, the surfactant is noncationic; and is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher.

Also, the process for preparing tissue paper in accordance with the present invention may further comprise the step of adding an effective amount of a binder material such as starch to at least partially offset any reduction of tensile strength and/or increase in linting propensity which would otherwise result from the incorporation of the polysiloxane and, if present, surfactant material. The effective amount of binder material is such that, preferably, from about 0.01 to about 2 percent on a dry fiber weight basis of the tissue paper, is retained by the tissue paper.

All percentages, ratios and proportions herein are by weight, unless otherwise specified.

BRIEF DESCRIPTION OF THE INVENTION

FIG. 1 is a schematic representation illustrating a preferred embodiment of the process of the present invention of adding polysiloxane compounds to a tissue web.

The present invention is described in more detail below.

DETAILED DESCRIPTION OF THE INVENTION

Figure 1:
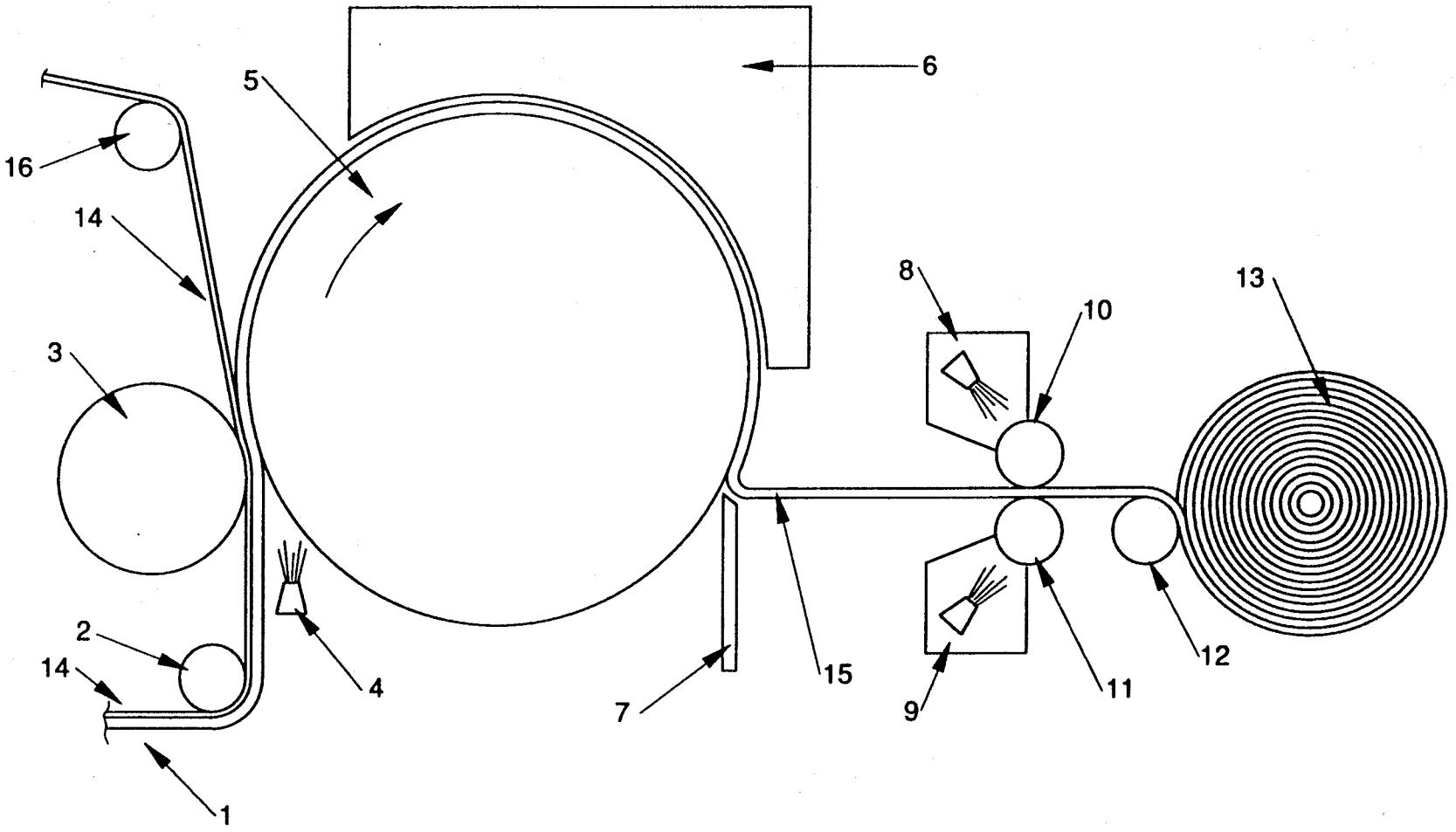

Briefly, the present invention provides tissue paper having a silky, flannel-like feel, and enhanced tactile perceivable softness through the addition of a polysiloxane additive to a dry tissue web. Preferably, the tissue web is dried to a moisture content below its equilibrium moisture content before the polysiloxane material is applied to the web. This process may also include the addition of an effective amount of surfactant material and/or a binder material such as starch to the wet web. Generally speaking, surfactant may be included to enhance tactile perceivable, physiological surface smoothness and/or to assure sufficient wettability for the intended purposes of the tissue paper (e.g., as toilet tissue); and a binder material such as starch may be included to at least partially offset any reduction of tissue paper tensile strength and/or exacerbation of linting propensity which would otherwise be precipitated by the addition of the polysiloxane and, if used, the surfactant.

Surprisingly, it has been found that very low levels of polysiloxane provide a significant tissue softening effect when applied to dry tissue webs in accordance with the present invention. Importantly, it has been found that the levels of polysiloxane used to soften the tissue paper are low enough that the tissue paper retains high wettability. Furthermore, because the tissue web is preferably overdried and at an elevated temperature when the polysiloxane compound is applied, any water added by the polysiloxane solution does not need to be removed. This eliminates the need to further dry the tissue, which might be required if the polysiloxane was added to a tissue web at its equilibrium moisture content.

As used herein, hot tissue web refers to a tissue web which is at an elevated temperature that is higher than room temperature. Preferably the elevated temperature of the web is at least 43° C., and more preferably at least 65° C.

The moisture content of a tissue web is related to the temperature of the web and the relative humidity of the environment in which the web is placed. As used herein, the term "overdried tissue web" refers to a tissue web that is dried to a moisture content below its equilibrium moisture content at standard test conditions of 23° C. and 50% relative humidity. The equilibrium moisture content of a tissue web placed in standard testing conditions of 23° C. and 50% relative humidity is approximately 7%. The tissue web in the present invention can be overdried by raising it to a elevated temperature through use of conventional drying means such as a Yankee dryer. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade. By applying a polysiloxane solution on the paper while it is overdried, any residual water that is added to the paper is less than what would normally be taken up from the atmosphere. Thus, no further drying is required, and no tensile loss is observed other than that which would normally occur if the paper were absorbing moisture from the air.

The present invention is applicable to tissue paper in general, including but not limited to conventionally felt-pressed tissue paper; pattern densified tissue paper such as exemplified by Sanford-Sisson and its progeny; and high bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial mechanical compressional forces while the fibers are moist and are then dried while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,191,609, issued to Paul D. Trokhan on Jan. 20, 1987; all of which are incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1979, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980, both of which are incorporated herein by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and in softness.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make tissue paper structures may have other components or materials added thereto as may be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymeme TM 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the mark Parez TM 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. In addition, temporary wet strength resins such as Caldas 10 (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

Types of polysiloxane materials which are suitable for use in the present invention include polymeric, oligomeric, copolymeric, and other multiple-monomeric siloxane materials. As used herein, the term polysiloxane shall include all of such polymeric, oligomeric, copolymeric and other multiple-monomeric siloxane materials. Additionally, the polysiloxane can be either a straight chain, a branched chain or have a cyclic structure.

Preferred polysiloxane materials include those having monomeric siloxane units of the following structure:

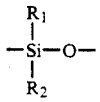

(1)

wherein, $R_1$ and $R_2$ for each siloxane monomeric unit can independently be any alkyl, aryl, alkenyl, alkaryl, aralkyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the radicals can be either a straight chain, a branched chain, or have a cyclic structure. The radicals $R_1$ and $R_2$ can, additionally and independently, be other silicone functionalities such as, but not limited to siloxanes, polysiloxanes, and polysilanes. The radicals $R_1$ and $R_2$ can also contain any of a variety of organic functionalities including, for example, alcohol, carboxylic acid, and amine functionalities.

The degree of substitution and the type of substituent have been found to affect the relative degree of soft, silky feeling and hydrophilicity imparted to the tissue paper structure. In general, the degree of soft, silky feeling imparted by the polysiloxane increases as the hydrophilicity of the substituted polysiloxane decreases. Aminofunctional polysiloxanes are especially preferred in the present invention.

Preferred polysiloxanes include straight chain organopolysiloxane materials of the following general formula:

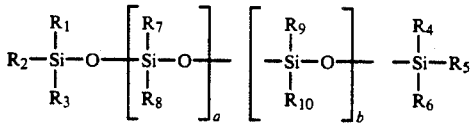

(2)

wherein each $R_1$–$R_g$ radical can independently be any $C_1$–$C_{10}$ unsubstituted alkyl or aryl radical, and $R_{10}$ is any substituted $C_1$–$C_{10}$ alkyl or aryl radical. Preferably each $R_1$–$R_9$ radical is independently any $C_1$–$C_4$ unsubstituted alkyl group. Those skilled in the art will recognize that technically there is no difference whether, for example, $R_9$ or $R_{10}$ is the substituted radical. Preferably the mole ratio of b to (a+b) is between 0 and about 20%, more preferably between 0 and about 10%, and most preferably between about 1% and about 5%.

In one particularly preferred embodiment, $R_1$–$R_9$ are methyl groups and $R_{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxanes include, for example, polydimethylsiloxane, polydimethylsiloxane having an alkyl hydrocarbon $R_{10}$ radical and polydimethylsiloxane having one or more amino, carboxyl, hydroxyl, ether, polyether, aldehyde, ketone, amide, ester, thiol and/or other $R_{10}$ functionalities including alkyl and alkenyl analogues of such functionalities. For example, an amino functional alkyl group as $R_{10}$ could be an amino-functional or an aminoalkylfunctional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane is flowable or can be made to be flowable for application to the tissue paper. This includes, but is not limited to, viscosity as low as about 25 centistokes to about 20,000,000 centistokes or even higher. High viscosity polysiloxanes which themselves are resistant to flowing can be effectively deposited upon the tissue paper webs by such methods as, for example, emulsifying the polysiloxane in surfactant or providing the polysiloxane in solution with the aid of a solvent, such as hexane, listed for exemplary purposes only. Particular methods for applying polysiloxanes to tissue paper webs are discussed in more detail below.

Parenthetically, while not wishing to be bound by a theory of operation, it is believed that the tactile-benefit efficacy of the polysiloxane is directly related to its average molecular weight; and that viscosity is directly related to molecular weight. Accordingly, due to the relative difficulty of directly determining molecular weights of polysiloxanes as compared to determining their viscosities, viscosity is used herein as the apparent operative parameter with respect to imparting enhanced tactile response to tissue paper: i.e., softness, silkiness, and flannel-like.

References disclosing polysiloxanes include U.S. Pat. No. 2,826,551, issued Mar. 11, 1958, to Geen; U.S. Pat.

No. 3,964,500, issued Jun. 22, 1976, to Drakoff; U.S. Pat. No. 4,364,837, issued Dec. 21, 1982, to Pader; and British Patent 849,433, published Sep. 28, 1960, to Woolston. Also, *Silicon Compounds*, pp. 181–217, distributed by Petrarch Systems, Inc., 1984, contains an extensive listing and description of polysiloxanes in general.

The polysiloxane is applied after the tissue web has been dried and creped, and preferably is still at an elevated temperature. It has been found that addition of the polysiloxane to the tissue web before the web is dried and creped can result in interference with the coating on the dryer (i.e., glue coating on Yankee dryer), and also cause skip crepe and a loss in sheet control. These problems are eliminated by the process of the present invention wherein the polysiloxane compounds are applied to the web after the web has been dried and creped. Preferably, the polysiloxane compounds are applied to the dried and creped tissue web before the web is wound onto the parent roll.

It has also been found that application of the polysiloxane followed by calendering of the tissue web further enhances the softness of the tissue product. Without being bound by theory, it is believed that the calender aids in distribution of the polysiloxane by working the sheet and moving the polysiloxane around on the fiber surfaces. Thus, in a preferred embodiment of the present invention the polysiloxane compound is applied to a hot, overdried tissue web after the web has been creped, but before the web passes through the calender rolls.

The polysiloxane is preferably applied to the hot transfer surface from an aqueous solution, emulsion, or suspension. The polysiloxane can also be applied in a solution containing a suitable, nonaqueous solvent, in which the polysiloxane dissolves or with which the polysiloxane is miscible: for example, hexane. The polysiloxane may be supplied in neat form or, more preferably, emulsified with a suitable surfactant emulsifier. Emulsified polysiloxane is preferable for ease of application since a neat polysiloxane aqueous solution must be agitated to inhibit separation into water and polysiloxane phases.

The polysiloxane should be applied uniformly to the transfer surface for subsequent uniform transfer to the tissue paper web so that substantially the entire sheet benefits from the tactile effect of the polysiloxane. Applying the polysiloxane to the tissue paper web in continuous and patterned distributions are both within the scope of the invention and meet the above criteria. Likewise, the polysiloxane can be added to either side of the tissue web singularly, or to both sides.

Methods of uniformly applying the polysiloxane to the hot transfer surface include spraying and gravure printing. Spraying has been found to be economical, and susceptible to accurate control over quantity and distribution of the polysiloxane, so it is most preferred. Preferably, an aqueous mixture containing an emulsified polysiloxane is applied from the transfer surface onto the dried, creped tissue web after the Yankee dryer and before the parent roll. FIG. 1 illustrates a preferred method of applying the polysiloxane to the tissue web. Referring to FIG. 1, a wet tissue web 1 is on carrier fabric 14 past turning roll 2 and transferred to Yankee dryer 5 by the action of pressure roll 3 while carrier fabric 14 travels past turning roll 16. The paper web is adhesively secured to the cylindrical surface of Yankee dryer 5 by adhesive applied by spray applicator 4. Drying is completed by steam-heated Yankee dryer 5 and by hot air which is heated and circulated through drying hood 6 by means not shown. The web is then dry creped from the Yankee dryer 5 by doctor blade 7, after which it is designated creped paper sheet 15. An aqueous mixture containing an emulsified polysiloxane compound is sprayed onto an upper heated transfer surface designated as upper calender roll 10 and/or a lower heated transfer surface designated as lower calender roll 11, by spray applicators 8 and 9 depending on whether the polysiloxane is to be applied to both sides of the tissue web or just to one side. The paper sheet 15 then contacts heated transfer surfaces 10 and 11 after a portion of the solvent has been evaporated. The treated web then travels over a circumferential portion of reel 12, and thence is wound onto parent roll 13. Equipment suitable for spraying polysiloxane-containing liquids onto hot transfer surfaces include external mix, air atomizing nozzles, such as the 2 mm nozzle available from V.I.B. Systems, Inc., Tucker, Georgia. Equipment suitable for printing polysiloxane-containing liquids onto hot transfer surfaces include rotogravure printers.

While not wishing to be bound by theory or to otherwise limit the present invention, the following description of typical process conditions encountered during the papermaking operation and their impact on the process described in this invention is provided. The Yankee dryer raises the temperature of the tissue sheet and removes the moisture. The steam pressure in the Yankee is on the order of 110 PSI (750 kPa). This pressure is sufficient to increase the temperature of the cylinder to about 173° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is measured to be on the order of 65° C. Eventually the sheet of paper cools to room temperature. This can take anywhere from hours to days depending on the size of the paper roll. As the paper cools it also absorbs moisture from the atmosphere. As previously mentioned, the moisture content in the sheet is related to the sheet temperature and the relative humidity of the environment in which the paper is placed. For example the equilibrium moisture content of a sheet placed in standard testing conditions of 23° C. and 50% RH is approximately 7%. Increasing the moisture content of the sheet above 7% can have a deleterious effect on the tensile strength of the paper. For example, a moisture increase to 9% can cause the tensile strength of the paper to decrease by as much as 15%.

One very surprising attribute of polysiloxane softeners is their ability to improve softness at very low levels on the surface of the paper. The polysiloxane softener, however needs to be fairly uniformly distributed on the paper surface in order for the consumer to recognize the improved softness. From a process standpoint, there was previously no satisfactory method of uniformly applying low quantities of a polysiloxane compound to a paper web traveling at a high rate of speed. Belt speeds of 700 to 1000 meters/minute (25 to 40 miles/hour) are typical in modern high speed paper machines. Webs traveling at these rates of speed generally have an air boundary layer on their surface. One method for applying low quantities of liquids is to use a spray system and adjust the air and/or liquid pressures. For example, one could go to low flow rates by using high air pressures. This generally produces extremely small particles. It is difficult to impart sufficient momentum into these small particles so they can penetrate the air boundary layer traveling on the surface of the fast moving paper web. Moreover, if one increases the particle size of the spray fluid so it can penetrate the air boundary layer at low flow rates the surface coverage becomes nonuniform.

One commonly used method for applying low levels of an active material is to first dilute the material with a solvent. The spray systems can then be adjusted to deliver larger particle sizes at high flow rates. The larger particles can penetrate the air boundary layer. However one is now faced with the problem of having to remove the solvent from the paper. Generally volatile organic solvents are not used in papermaking, since they can be fire or environmental hazards. Water can be used as a solvent, or more appropriately as a diluent, for the polysiloxane, if the polysiloxane is first emulsified with a suitable surfactant system. While water does not pose the same process risks as an organic solvent, water can degrade the product, causing a loss in crepe and/or tensile strength. Further the water needs to be removed from the paper.

One solution to the water problem is to apply a dilute polysiloxane solution to the paper while it is overdried. The water added to the paper by this method is usually less than the paper would normally take up from the atmosphere upon cooling to room temperature. Thus, no further drying is required, and no loss in tensile strength occurs from addition of the water. However, the water solution is capable of penetrating the entire sheet causing the active material to spread to the inside of the sheet rather than staying on the surface of the paper where it is most effective. Further, this process is limited to an overdried sheet, making application to the paper during a converting process (an off paper machine process) difficult without adding an additional drying step to the process. A further limitation to this process is the limited dilution range and application range of the polysiloxane emulsion imposed by the emulsion properties, (i.e., high concentrations tend to have high viscosities, whereas low concentrations increase the amount of water sprayed on the sheet).

The present invention solves the above described problems by first spraying a dilute emulsified polysiloxane solution onto a hot transfer surface and evaporating the solvent from the polysiloxane solution before transferring it to the dry web. For exemplary purposes, a typical commercially available silicone emulsion is Dow Corning (R ®) Q2-7224 Conditioning Agent marketed by the Dow Corning Corporation. This material generally contains about 35% by weight of an amino-functional polysiloxane emulsified in water. This silicone receipt emulsion is diluted with water to less than about 20% concentration, by weight, before being applied to the heated transfer surface. More preferably, silicone emulsions used in the present invention are first diluted with water to less than about 15% concentration by weight before being applied to the transfer surface.

Exemplary materials suitable for the heated transfer surfaces include metal, e.g., steel, stainless steel, and chrome and rubber. When the diluted polysiloxane emulsion was sprayed on the hot transfer surface, in this case a steel calender roll, it was most surprising to discover that little or no water was transferred to the paper web by this process. In fact, under one set of process conditions, it was expected that the sheet moisture content would increase from a base of 4% to 5% after spraying. However, it was found that the moisture content did not increase at all, while the silicone content in the web did increase to its expected concentration. It was a further surprise to find that an attempt to increase the sheet moisture by 3.5% (i.e., raising the sheet moisture from 4 to 7.5%) only resulted in a moisture increase of 0.7%, that is the measured moisture content was only 4.7%.

This is most surprising since the roll temperature is on the order of 80° C. (20° C. below the boiling point of water) and the time between the point of application and point of transfer is on the order of 0.1 sec. It was surprising to discover that greater than 50% of the water had evaporated from the roll under these conditions, leaving behind a thin film of polysiloxane emulsion. This thin film was calculated to be on the order of 0.25 microns thick (1 micron $=10^{-6}$ meters). The films of the present invention are preferably less than about 10 microns in thickness, and more preferably, less than about one micron in thickness.

By thin film is meant any thin coating, haze or mist on the transfer surface. This thin film can be microscopically continuous, dscrete, or patterned, but should be macroscopically uniform.

In the process of the present invention it is preferred that at least about 50%, more preferably at least about 80%, of the water is evaporated from the dilute polysiloxane solution applied to the heated transfer surface before transferring it to the dry tissue web. This leaves a film, with a calculated thickness of about 0.075 microns thick. Most preferably greater than about 95% of the water is evaporated from the solution on the heated transfer surface, leaving a calculated film thickness of about 0.05 microns for transfer to the paper web.

The heat on the transfer surface can also cause a lowering of the polysiloxane viscosity, thus increasing its ability to spread into a thin film on the transfer surface. This film is then transferred to the paper web surface by contacting the web with the transfer surface. Surprisingly, it has been found that the polysiloxane transfer efficiency to the web is quite high. Efficiencies on the order of 40 to 80% are typical, based on the flow out of the spray nozzles to the transfer surface and the quantity measured on the paper web. Moreover, this process is not limited to overdried paper. Depending on the amount of water removed from the spray mixture by the hot transfer surface, the process described herein is capable of delivering polysiloxane softeners to equilibrated dry paper as well. However application to a hot overdried web is preferred, to insure that any residual water in the film does not interfere with any paper properties.

An additional benefit in applying the polysiloxane solution to a hot overdried web is that the decreased viscosity of the solution aids in insuring that the solution is uniformly applied across the surface of the web. (It is believed that the low viscosity solution is more mobile).

It has been found, surprisingly, that low levels of polysiloxane applied to hot, overdried tissue paper webs can provide a softened, silky, flannel-like, nongreasy tactile sense of feel to the tissue paper without the aid of additional materials such as oils or lotions. Importantly, these benefits can be obtained for many of the embodiments of the present invention in combination with high wettability within the ranges desirable for toilet paper application. Preferably, tissue paper treated with polysiloxane in accordance with the present invention comprises about 0.75% or less polysiloxane. It is an unexpected benefit of this invention that tissue paper treated with about 0.75% or less polysiloxane can have imparted thereto substantial softness and silkiness benefits by such a low level of polysiloxane. In general, tissue paper having less than about 0.75% polysiloxane, preferably less than about 0.5%, can provide substantial increases in softness and silkiness and flannel-like quality yet remain sufficiently wettable for use as toilet paper without requiring the addition of surfactant to offset any negative impact on wettability which results from the polysiloxane.

The minimum level of polysiloxane to be retained by the tissue paper is at least an effective level for imparting a tactile difference in softness or silkiness or flannel-like quality to the paper. The minimum effective level may vary depending upon the particular type of sheet, the method of application, the particular type of polysiloxane, and whether the polysiloxane is supplemented by starch, surfactant, or other additives or treatments. Without limiting the range of applicable polysiloxane retention by the tissue paper, preferably at least about 0.004%, more preferably at least about 0.01%, and most preferably at least about 0.05% polysiloxane is retained by the tissue paper.

Preferably, a sufficient amount of polysiloxane to impart a tactile sense of softness is disposed uniformly on both surfaces of the tissue paper: i.e., disposed on the outwardly facing surfaces of the surface-level fibers. When polysiloxane is applied to one surface of the tissue paper, some of it will, generally, at least partially penetrate to the tissue paper interior. However, preferably, the polysiloxane is applied to both sides of the tissue paper to ensure that both surfaces have imparted thereto the benefits of the polysiloxane.

In addition to treating tissue paper with polysiloxane as described above, it has been found desirable to also treat such tissue paper with surfactant material. This is in addition to any surfactant material that may be present as an emulsifying agent for the polysiloxane.

Tissue paper having in excess of about 0.3% polysiloxane is preferably treated with surfactant when contemplated for uses wherein high wettability is desired. Most preferably, a noncationic surfactant is applied to the hot, overdried tissue paper web, in order to obtain an additional softness benefit, on a constant tensile basis, as previously discussed. The amount of surfactant required to increase hydrophilicity to a desired level will depend upon the type and level of polysiloxane and the type of surfactant. However, as a general guideline, between about 0.01% and about 2% surfactant retained by the tissue paper, preferably between about 0.05% and about 1.0%, is believed to be sufficient to provide sufficiently high wettability for most applications, including toilet paper, for polysiloxane levels of about 0.75% or less.

Surfactants which are preferred for use in the present invention are noncationic; and, more preferably, are nonionic. However, cationic surfactants may be used. Noncationic surfactants include anionic, nonionic, amphoteric, and zwitterionic surfactants. Preferably, as stated hereinbefore, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher. Also, the surfactant is preferably water-soluble when applied to the wet web.

The level of noncationic surfactant applied to tissue paper webs to provide the aforementioned softness/tensile benefit ranges from the minimum effective level needed for imparting such benefit, on a constant tensile basis for the end product, to about two (2) percent: preferably between about 0.01% and about 1% noncationic surfactant retained by the web; more preferably, between about 0.05% and about 1.0%; and, most preferably, between about 0.05% and about 0.3%.

The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta TM SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse TM 200 ML available from Glyco Chemicals, Inc. (Greenwich, Conn.). Alkylpolyglycosides are particularly preferred for use in the present invention. The above listings of exemplary surfactants are intended to be merely exemplary in nature, and are not meant to limit the scope of the invention.

The surfactant, in addition to any emulsifying surfactant that may be present on the polysiloxane, may be applied by the same methods and apparatuses used to apply polysiloxanes. These methods include spraying and gravure printing. Other methods include application to a forming wire or fabric prior to contact with the web. Any surfactant other than polysiloxane emulsifying surfactant material, is hereinafter referred to as "surfactant," and any surfactant present as the emulsifying component of emulsified polysiloxane is hereinafter referred to as "emulsifying agent".

The surfactant may be applied to the tissue paper simultaneously with, after, or before the polysiloxane. In a typical process, the surfactant is applied to an overdried web simultaneously with the polysiloxane, that is, the surfactant is included in the dilute polysiloxane solution applied to the heated transfer surface.

As stated hereinbefore, it is also desirable to treat polysiloxane containing tissue paper with a relatively low level of a binder for lint control and/or to increase tensile strength. As used herein the term "binder" refers to the various wet and dry strength additives known in the art. The binder may be applied to the tissue paper simultaneously with, after or before the polysiloxane and the surfactant, if used. Preferably, binders are added to the overdried tissue webs simultaneously with the polysiloxane (i.e., the binder is included in the dilute polysiloxane solution applied to the heated transfer surface).

Starch has been found to be the preferred binder for use in the present invention. Preferably, the tissue paper is treated with an aqueous solution of starch, and, as mentioned above, the sheet is overdried at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch From Waxy Corn", H. H. Schopmeyer, Food Industries, Dec. 1945, pp. 106-108 (Vol. pp. 1476-1478).

The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However, when applied in accordance with this invention by application to an overdried tissue paper web they may have reduced effect on wet strength relative to wet-end addition of the same modified starch materials. Considering that such modified starch materials are more expensive than unmodified starches, the latter have generally been preferred.

Starch is preferably applied to tissue paper webs in an aqueous solution. Methods of application include, the same previously described with reference to application of polysiloxane: preferably by spraying; and, less preferably, by printing. The starch may be applied to the tissue paper web simultaneously with, prior to, or subsequent to the addition of polysiloxane and/or surfactant.

At least an effective amount of a binder, preferably starch, to provide lint control and concomitant strength increase upon drying relative to a non-binder treated but otherwise identical sheet is preferably applied to the sheet. Preferably, between about 0.01% and about 2.0% of a binder is retained in the dried sheet, calculated on a dry fiber weight basis; and, more preferably, between about 0.1% and about 1.0% of a binder material, preferably starch-based, is retained.

Analysis of the amounts of treatment chemicals herein retained on tissue paper webs can be performed by any method accepted in the applicable art. For example, the level of polysiloxane retained by the tissue paper can be determined by solvent extraction of the polysiloxane with an organic solvent followed by atomic absorption spectroscopy to determine the level of silicon in the extract; the level of nonionic surfactants, such as alkylglycosides, can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a conditioned sample unit sheet (the environmental conditions for testing of paper samples are 23°±1° C. and 50±2% RH. as specified in TAPPI Method T 402), approximately 4⅜ inch×50±2% inch (about 11.1 cm×12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 23°±1° C. and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 g/in$^2$ (15.5 g/cm$^2$).

EXAMPLE I

The purpose of this example is to illustrate one method that can be used to make soft tissue paper sheets treated with a polysiloxane in accordance with the present invention.

A pilot scale Fourdrinier papermaking machine is used in the practice of the present invention. The paper machine has a layered headbox having a top chamber, a center chamber, and a bottom chamber. Where applicable as indicated in the following examples, the procedure described below also applies to such later examples. Briefly, a first fibrous slurry comprised primarily of short papermaking fibers is pumped through the top and bottom headbox chambers and, simultaneously, a second fibrous slurry comprised primarily of long papermaking fibers is pumped through the center headbox chamber and delivered in superposed relation onto the Fourdrinier wire to form thereon a three-layer embryonic web. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The embryonic wet web is transferred from the Fourdrinier wire, at a fiber consistency of about 22% at the point of transfer, to a carrier fabric having a 5-shed satin weave, 35 machine-direction and 33 cross-machine-direction monofilaments per inch, respectively. The web is carried on the carrier fabric past the vacuum dewatering box, through the blow-through predryers after which the web is transferred onto a Yankee dryer. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at about 800 fpm (feet per minute) (about 244 meters per minute). The heated calender rolls are sprayed with a polysiloxane emulsion, further described below, using a 2 mm spray nozzle. The web is then passed between the two heated calender rolls. The two calender rolls are biased together at roll weight and operated at surface speeds of 660 fpm (about 201 meters per minute).

The spray solution is made by diluting Dow Corning Q2-7224 (a 35% nonionic emulsion of an amino-functional polydimethylpolysiloxane marketed by Dow Corning Corp.) to 3% by weight with water. The aqueous polysiloxane solution is then sprayed onto the heated lower steel calender roll. The volumetric flow rate of the aqueous solution through the nozzle is about 2 gal/hr cross-direction ft (about 25 liters/hr-meter). Greater than about 95% of the water is evaporated from the calender rolls leaving a calculated polysiloxane film thickness of less than 0.07 microns. The dry web, which has a moisture content of about 1%, contacts the hot calender rolls. The polysiloxane compound is transferred to the dry web by direct pressure transfer The transfer efficiency of the polysiloxane applied to the web, in general, is about 45%.

The resulting tissue paper has a basis weight of 30 g/m$^2$, a density of 0.10 g/cc, and contains 0.10% by weight, of the amino-functional polydimethylpolysiloxane compound and has an unequilibrated initial moisture content of 1.2%.

EXAMPLE II

The purpose of this example is to illustrate one method that can be used to make soft tissue paper sheets wherein the tissue paper is treated with polysiloxane, surfactant and starch.

A 3-layer paper sheet is produced in accordance with the hereinbefore described process of Example I. The tissue web is, in addition to being treated with a polysiloxane compound as described above, also treated with Crodesta TM SL-40 (an alkyl glycoside polyester nonionic surfactant marketed by Croda Inc.) and with a fully cooked amioca starch prepared as described in the specification. The surfactant and starch are applied simultaneously with the emulsified polysiloxane composition as part of the aqueous solution sprayed through the papermachine spray nozzle. Concentration of the Crodesta TM SL-40 nonionic surfactant in the aqueous solution is adjusted so that the level of surfactant retained is about 0.10%, based upon the weight of the dry fibers. Similarly, concentration of the starch in the aqueous solution is adjusted so that the level of amioca starch retained is about 0.2%, based upon the weight of the dry fibers.

The treating mixture is sprayed onto an upper and a lower heated transfer roll. The water is evaporated from the rolls and the active polysiloxane, surfactant, and binder is transferred to both sides of the tissue web. The volumetric flow rate through the upper and lower spray nozzle onto the heated rolls is about 1 gal/hr cross-direction ft. The combined flow rate through both nozzles is 2 gal/hr cross-direction ft.

The resulting tissue paper has a basis weight of 30 g/mz, a density of 10 g/cc, and contains 0.10% by weight of the Dow Q2-7224 amino-functional polydimethypolysiloxane, 0.15% by weight of Crodesta TM SL-40 nonionic surfactant and 0.2% by weight of the cooked amioca starch. Importantly, the resulting tissue paper has a silky flannel-like feel, enhanced tactile softness and has higher wettability and lower propensity for lint than tissue paper treated only with the polysiloxane composition.

EXAMPLE III

The purpose of this example is to illustrate one method that can be used to make soft tissue paper sheets wherein the tissue paper is treated in accordance with the present invention and converted into a two ply product.

A 2-layer paper sheet is produced in accordance with the hereinbefore described process of Example I with the following exceptions. The volumetric flow rate through the nozzle is approximately 1.05 gal/hr cross-direction foot (about 13.3 liters/hr-meter). The film thickness after 95% of the water is evaporated is calculated to about 0.035 microns. The resulting single ply tissue paper has a basis weight of 16 g/m$^2$.

Following papermaking, two sheets of treated paper are combined together with the treated surfaces facing outward.

The resulting two-ply tissue paper product has a basis weight of 32 g/m$^2$, a density of 0.10 g/cc, and contains 0.10% by weight, of the amino-functional polydimethylsiloxane.

Importantly, the resulting tissue paper has a silky, flannel-like feel, and enhanced tactile softness.

What is claimed is:

1. An improved process for applying a polysiloxane compound to a dried and creped tissue paper web, said process comprising the steps of:

a) providing a dried and creped tissue paper web;

b) diluting a polysiloxane compound with a suitable solvent to form a dilute polysiloxane solution;

c) applying said dilute polysiloxane solution to a heated transfer surface, wherein said heated transfer surface is a hot cylinder roll;

d) evaporating at least a portion of said solvent from said hot calender roll to form a film containing said polysiloxane compound; and e) transferring said film from said hot calender roll to at least one outwardly-facing surface of said dried and creped tissue web by contacting said outwardly-facing web surface with said hot calender roll, and transferring a sufficient amount of said polysiloxane compound;

such that from about 0.004% to about 0.74% of said polysiloxane compound, based on the dry fiber weight of said tissue web, is retained by said tissue web.

2. The process of claim 1 wherein the solvent in step (b) is water.

3. The process of claim 2 wherein said polysiloxane in step (b) further comprises an effective amount of an emulsifier.

4. The process of claim 3 wherein from about 0.01% to about 0.3% of said polysiloxane is retained by said web.

5. The process of claim 3 wherein said polysiloxane is a polydimethylpolysiloxane having a hydrogen bonding functional group selected from the groups consisting of amino, carboxyl, hydroxyl, ether, polyether, aldehyde, ketone, amide, ester and thiol groups, said hydrogen bonding functional group being present in a molar percentage of substitution of about 20% or less.

6. The process of claim 5 wherein said polysiloxane has a molar percentage of substitution of about 10% or less, and a viscosity of about 25 centistokes or more.

7. The process of claim 5 wherein said polysiloxane has a molar percentage of substitution of from about 1.0% to about 5%, and a viscosity of from about 25 centistokes to about 20,000,000 centistokes.

8. The process of claim 5 wherein said molar percentage of substitution is about 2%, and said viscosity is about 125 centistokes.

9. The process of claim 5 wherein said hydrogen bonding functional group is an amino functional group.

10. The process of claim 3 further comprising the step of applying to said web, a sufficient amount of water soluble surfactant such that from about 0.01% to about 2.0% of said surfactant, based on the dry fiber weight of said tissue paper, is retained by said web.

11. The process of claim 10 wherein said quantity of said surfactant is from about 0.05% to about 1.0% based on the dry fiber weight of said tissue paper.

12. The process of claim 10 wherein said surfactant is noncationic.

13. The process of claim 12 wherein said noncationic surfactant is a nonionic surfactant.

14. The process of claim 10 wherein said surfactant has a melting point of at least about 50° C.

15. The process of claim 3 further comprising the step of applying to said web, a sufficient amount of a binder such that from about 0.01% to about 2.0% said binder, based on the dry fiber weight of said tissue paper, is retained by said web.

16. The process of claim 15 wherein said binder is starch.

17. The process of claim 16 wherein from about 0.1% to about 1.0% of said starch, based on the dry fiber weight of said tissue paper, is retained by said weight.

18. The process of claim 15 wherein said starch is amioca starch.

19. The process of claim 10 further comprising the step of applying to said web, a sufficient amount of a binder such that from about 0.01% to about 2.0% of said binder, based on the dry fiber weight of said tissue paper, is retained by said web.

20. The process of claim 19 wherein said surfactant is noncationic and wherein said binder is starch.

* * * * *

UNITED STATES PATENT AND TRADEMARK OFFICE

CERTIFICATE OF CORRECTION

PATENT NO. : 5,246,546

DATED : September 21, 1993

INVENTOR(S) : Robert S. Ampulski

It is certified that error appears in the above-identified patent and that said Letters Patent is hereby corrected as shown below:

Column 1, line 11 "silkyl" should read --silky--.

Column 6, line 51 "4,191,609" should read --4,637,859--.

Column 10, line 14 "$R_g$" should read --$R_9$--.

Column 13, line 51 "(R®)" should read --®--.

Column 18, line 37 "50±2%" should read --4¾--.

Column 20, line 46 "g/mz" should read --$g/m^2$--.

Column 20, line 46 "10 g/cc" should read --0.10 g/cc--.

Column 21, line 22 "cylinder" should read --calender--.

Signed and Sealed this

Twenty-sixth Day of March, 1996

Bruce Lehman

*Attest:*

BRUCE LEHMAN

*Attesting Officer*

*Commissioner of Patents and Trademarks*